US010155637B2

(12) United States Patent
Lupi et al.

(10) Patent No.: US 10,155,637 B2
(45) Date of Patent: Dec. 18, 2018

(54) MACHINE FOR THE FORMATION OF NUMBERED PACKS OF INTERLEAVED SHEETS OF PAPER

(71) Applicant: UNITED CONVERTING S.R.L., Coreglia Antelminelli-Lucca (IT)

(72) Inventors: Giuseppe Lupi, Gallicano-Luca (IT); Gianluca Giometti, Capannori-Lucca (IT); Angelo Torri, Gallicano-Luca (IT)

(73) Assignee: UNITED CONVERTING S.R.L., Coreglia Antelminelli-Lucca (IT)

( * ) Notice: Subject to any disclaimer, the term of this patent is extended or adjusted under 35 U.S.C. 154(b) by 550 days.

(21) Appl. No.: 14/758,631

(22) PCT Filed: Dec. 17, 2013

(86) PCT No.: PCT/IT2013/000349
§ 371 (c)(1),
(2) Date: Jun. 30, 2015

(87) PCT Pub. No.: WO2014/115180
PCT Pub. Date: Jul. 31, 2014

(65) Prior Publication Data

US 2015/0336766 A1 Nov. 26, 2015

(30) Foreign Application Priority Data

Jan. 22, 2013 (IT) ..... FI2013A0017

(51) Int. Cl.
*B65H 45/24* (2006.01)
*B65H 29/20* (2006.01)
(Continued)

(52) U.S. Cl.
CPC ..... *B65H 31/3054* (2013.01); *B65H 29/20* (2013.01); *B65H 31/32* (2013.01);
(Continued)

(58) Field of Classification Search
CPC .... B65H 31/3054; B65H 31/32; B65H 45/24; B65H 29/20; B65H 2220/09; B65H 2403/532; B65H 2701/1924; B65H 37/06
See application file for complete search history.

(56) References Cited

U.S. PATENT DOCUMENTS

| | | | | |
|---|---|---|---|---|
| 3,599,805 A * | 8/1971 | Spencer | ..... | B65H 31/3054 271/218 |
| 4,770,402 A | 9/1988 | Couturier | | |
| 2004/0126172 A1 * | 7/2004 | Matteis | ..... | B65H 31/32 400/578 |

FOREIGN PATENT DOCUMENTS

| | | |
|---|---|---|
| EP | 1 415 945 A1 | 5/2004 |
| JP | H07 291527 A | 11/1995 |
| WO | 01/24997 A1 | 4/2001 |

OTHER PUBLICATIONS

International Search Report, dated May 13, 2014, from corresponding PCT application.

* cited by examiner

*Primary Examiner* — Robert Long
*Assistant Examiner* — Xavier A Madison
(74) *Attorney, Agent, or Firm* — Young & Thompson

(57) ABSTRACT

A machine for the formation of numbered packs of interleaved sheets of paper (6), includes a pair of counter-rotating motor-driven folding rollers (2, 3), an interference surface (11) mobile with a to-and-fro motion between a position (P1) of non-interference and a position (P2) of interference, and a mechanism (36) of cyclic movement of the surface (11) including at least one supporting crank (13) oscillating with respect to the carriage (26) and articulated to a first axis (15) of rotation of the surface, and a first motor-driven connecting rod (19) kinematically connected to the surface (11) to bestow the to-and-fro motion thereon.

20 Claims, 14 Drawing Sheets

(51) Int. Cl.
*B65H 37/06* (2006.01)
*B65H 31/30* (2006.01)
*B65H 31/32* (2006.01)

(52) U.S. Cl.
CPC ..... *B65H 37/06* (2013.01); *B65H 45/24* (2013.01); *B65H 2220/09* (2013.01); *B65H 2403/532* (2013.01); *B65H 2701/1924* (2013.01)

DETAIL C

MACHINE FOR THE FORMATION OF NUMBERED PACKS OF INTERLEAVED SHEETS OF PAPER

TECHNICAL SECTOR OF THE INVENTION

The invention relates to a machine for the formation of numbered packs of interleaved sheets of paper, of the type commonly used in the dispensers of stacked sheets in such a way as to facilitate successive extraction of the sheets, i.e., in such a way that each sheet that is extracted presents a flap of the next sheet ready to be gripped.

This effect is traditionally obtained by folding the sheets with so-called Z-profiles or V-profiles obtained using folding rollers that set on top of the trailing flap of each sheet the leading flap of the next sheet, which is thus raised following upon extraction of the previous sheet.

PRIOR ART

There is known machinery that forms numbered packs of interleaved sheets, comprising in general a pair of folding rollers that continuously supplies a succession of sheets on vertically mobile stack-growth brackets, on which numbered packs of sheets are formed.

The number of sheets is established by the intervention of further selection brackets, synchronized with the speed of rotation of the rollers, which intercept the sheets and interrupt formation of the pack on the stack-growth brackets and start a new one, whilst the pack already formed is removed from the stack-growth brackets and sent on, by means of conveyor belts, for subsequent treatments, for example packaging. An interleaving machine is known from the document No. 1415945, which describes a mechanism for gathering and separating packs of interleaved sheets coming from a set of folding rollers, wherein two growth surfaces and two separation surfaces set at the sides of the channel in which the sheets drop alternate to intercept the sheets. The separation surfaces have the function of defining a provisional plane for growth of the new pack being formed and are constituted by brackets constrained to an articulated-quadrilateral mechanism mounted on a vertically mobile carriage that is moved by a crank that gets the brackets to carry out strokes with reciprocating to-and-fro motion. With the mechanism described, the movement of entry and exit of the separation brackets from the stack-growth channel, occurs following a substantially rectilinear path.

In this known machinery, a recurrent problem is that the formation of the new pack cannot start until, at the end of each cycle, the separation brackets have not come out of the stack-growth channel to enable the growth surface (or the brackets) to position themselves again underneath the surface for formation of the first sheet of each pack. Furthermore, the delay in the formation of the new pack depends upon the speed employed by the separation brackets to return into a position of start of cycle that must coincide as far as possible with a position interfering with the line of formation of the first fold on the surface of the folding roller.

Conventionally, the above problem has been tackled by providing a grooved pattern on the folding roller with toroidal grooves corresponding to the brackets, which prevent contact between brackets and rollers and enable insertion of the separation brackets in the immediate proximity of the surface of the rollers themselves.

The toroidal grooves represent, however, a significant increase in cost and do not solve the problem of providing the separation brackets with an optimal entry and exit path.

A further drawback is represented by the need to size and design the selection brackets on the basis of the folding rollers and hence the impossibility of changing the format of the sheets, which is determined by the diameter of the folding rollers, unless there is also an intervention on the geometry of the selection brackets.

A further drawback is represented by the fact that the need to shape the folding surface of the rollers entails a deterioration in the quality of the sheets produced that come into contact with the surface grooves of the rollers.

PURPOSE OF THE INVENTION

The purpose of the present invention is to propose a machine for the formation of numbered packs of sheets that enables the drawbacks of the solutions already known to be overcome and in particular the work times necessary for formation of numbered packs of sheets to be reduced.

SUMMARY OF THE INVENTION

The above purposes have been achieved by providing a machine according to at least one of the annexed claims.

A first advantage lies in the fact that the path of the stack-growth brackets that can be obtained thanks to the machine according to the invention enables a reduction in the minimum times necessary for each pack-formation cycle and hence the productivity of the machine.

A second advantage lies in the greater surface regularity of the folding rollers and hence in the better quality of the sheets that can be obtained.

A further advantage lies in the possibility of adapting the mechanism that moves the selection brackets on the basis of the size of the folding rollers and hence of the format of the sheets.

LIST OF THE DRAWINGS

The above and further advantages will be better understood by any person skilled in the branch from the ensuing description and from the annexed drawings, which are provided by way of non-limiting example and in which.

Figure 6:
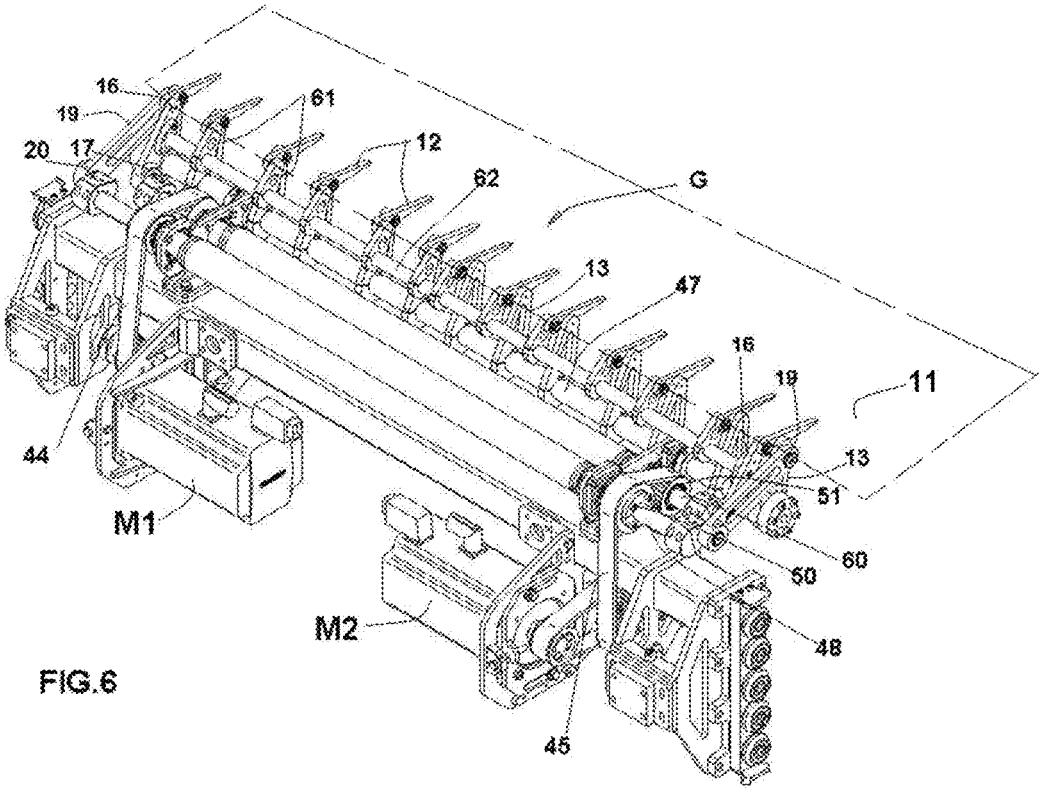
Figure 7:
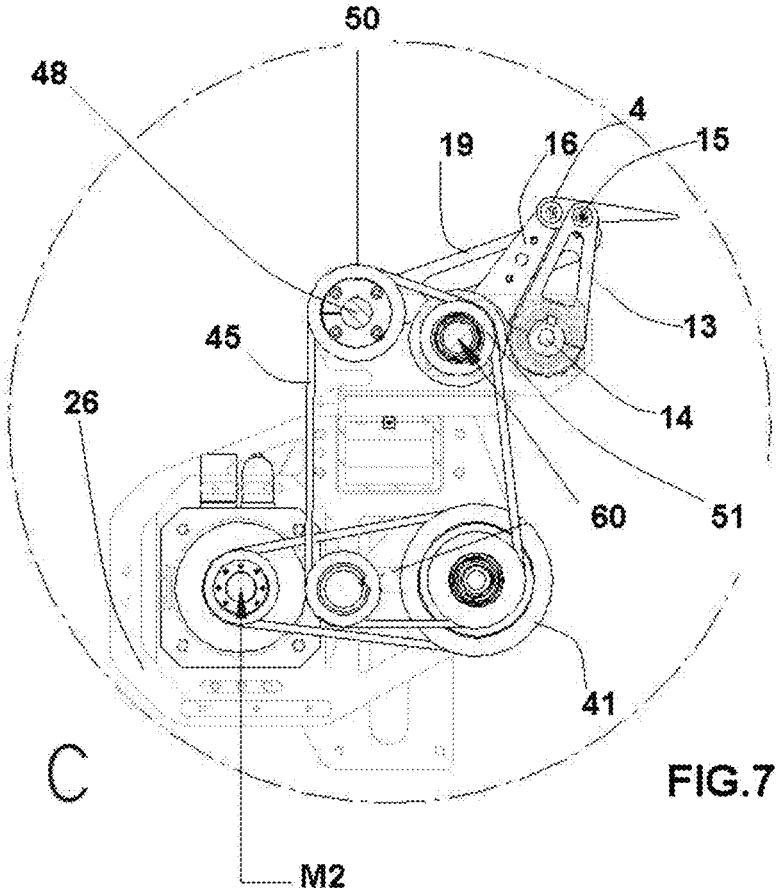

FIGS. 4*a*-4*i* and 4*l* show the succession of operating steps of the machine in the area of formation of the numbered packs of sheets;

FIGS. 5*a*-5*e* show the succession of operating steps of the machine, in partial front view, in the formation of the packs and expulsion of packs of sheets formed;

FIG. 6 shows a detail in axonometric view of the assembly carrying the interference brackets;

FIG. 7 is a schematic illustration of a detail of the mechanism of movement of the interference brackets; and FIGS. 8*a*-8*f* show schematically the positions assumed by the mechanism of FIG. 7 in a complete cycle.

DETAILED DESCRIPTION

With reference to the annexed drawings, a machine is described for the formation of numbered packs of interleaved sheets of paper 6.

The machine comprises a pair of counter-rotating motor-driven folding rollers 2, 3 shaped on the surface so as to interfere along a plurality of folding lines 7, 8.

In one example of embodiment, the folding lines 7, 8 are obtained by providing, on a first roller 2, the longitudinal grooves 22 to which there correspond longitudinal ribbings 23 on the second roller 3, in such a way that during rotation the slots 22 and the ribbings 23 constitute, in combination, nippers operating along the lines 7, 8, thus causing folding of the sheets 6 comprised between the two rollers. Each roller is moreover supplied with a succession of sheets 6 (e.g., FIG. 8*a*) that are drawn by the surfaces 64, 65 of the rollers into a position where they are staggered one with respect to the next so as to overlap along at least one common folding line 7 of interleaving, where the sheets 6 drawn by the two rollers are set overlapping and are folded simultaneously to create an engagement between the trailing flap of one sheet and the leading flap of the next adjacent sheet. Provided downstream of the folding rollers 2, 3 in the direction of feed of the paper, is a plurality of stack-growth brackets 10 distributed longitudinally underneath the rollers and extending in a direction transverse thereto to enable gathering of the succession of interleaved sheets of paper folded by the overlying rollers. For this purpose, the stack-growth brackets are fixed with respect to a structure 43 connected to a belt transmission 42 moved by means of one or more motors M4 along linear guides 63 at a speed associated to the speed of rotation of the rollers, i.e., the rate of formation of folded sheets, thus defining a stack-growth channel 33 with direction A delimited by vertical posts 38.

In a position intermediate between the rollers and the stack-growth brackets, provided along the channel 33 are interference means synchronized with the speed of rotation of the rollers 2, 3 and set for interrupting upon command the succession of sheets gathered by the stack-growth brackets and thus forming numbered packs 34 of interleaved sheets of paper.

At the end of formation of each pack 34, the stack-growth brackets 10 drop until they release the pack 34 onto an underlying conveyor belt 25 driven by a motor M6 and presenting a horizontal movement synchronized with the movement of the brackets for removing the numbered packs 34 (FIGS. 5*a*-5*e*) laterally.

According to the invention, the interference means comprise a interference surface 11 (schematically represented in FIG. 6), mobile in a first tangential direction external to a folding roller 2 and inclined with respect to the line of growth A. As a result of the movement of insertion, the surface 11 passes from a position P1 of non-interference to a position P2 of interference with the stack-stack-growth channel 33, where it intercepts the succession of interleaved sheets of paper coming off the rollers and interrupts the growth of the pack of sheets 6 already gathered on the stack-growth brackets. Preferably, at the rollers 2, 3 there may be provided doctors 35 having an oscillating movement synchronized with the speed of rotation of the roller, and capable of facilitating detachment of the sheets 6 from the surface of the roller itself.

Advantageously, the path followed by the surface 11 is external to the folding rollers, and it is hence not necessary to provide toroidal slots on the rollers to enable entry of brackets or other elements constituting the surface. The absence of these toroidal slots on the rollers leaves the surface of the roller intact (with function of contrast for the folding nippers) to maintain an optimal quality of folding throughout the length of the sheet.

Preferably, after insertion of the surface 11 and during the first stage of the movement downwards of the stack-growth brackets, the sheets folded by the rollers start to deposit on the interference surface itself, which thus performs a provisional function of growth of the new pack being formed, and for this purpose presents a movement parallel to the line of growth A in a plane of lie orthogonal to the line of growth A.

In the preferred embodiment illustrated, the surface 11 is moved between the position of non-interference and the position of interference by means of a mechanism with two degrees of freedom 36 supported by a carriage 26 mobile along linear guides 32 in the direction of growth A.

In greater detail, the surface 11 is defined by a plurality of parallel interference brackets 12 distributed throughout the length of the rollers 2, 3, and actuated by a mechanism 36 that comprises:

- a belt transmission 40 connected to a motor M5 for vertical displacement of the carriage 26;
- a number of oscillating cranks 13 connected by a transverse shaft 47, which are articulated to a fixed point 14 of the carriage and to an intermediate point 15 of one or more brackets 12;
- a first pair of oscillating connecting rods 16 connected by a tie rod 62 and by a motor-driven transverse shaft 60, moved via a second belt transmission 44 and pulleys 41 by a motor M1 and articulated at one end 28 to a first cam 17 mounted on the carriage 26 and at the opposite end 4 to at least one bracket 12;
- a second pair of oscillating connecting rods 19 connected by a transverse shaft 48, moved via a third belt transmission 45 by a motor M2 and articulated at one end 30 to a second cam 20 mounted on the carriage and at the opposite end 29 to the crank 13, in the proximity of the intermediate point 15; and
- a plurality of intermediate connecting rods 61 mounted on the tie rod 62 and connected to respective brackets 12.

Schematically illustrated in FIG. 6 is the set of the interference brackets mounted on the carriage 26 and the position of the two motors M1, M2 each associated to the respective belt transmission 44, 45 for transmitting motion to the connecting rod 16 or 19. In the illustration, the motor M2 is located on the right side (FIG. 6) of the carriage 26 and moves the cam 20 connected to the connecting rod 19 by means of a toothed pulley 50, whilst the connecting rod 16 (or rather the cam 17 that moves the connecting rod 16) is mounted on an idle return pulley 51, and is instead driven by the motor M1 on the opposite side of the shaft 60, where the cam 20 that moves the connecting rod 19 is in turn mounted on an idle return pulley.

Illustrated schematically in FIG. 7 is the mechanism, represented in a side view functionally equivalent to the view from the opposite side of the carriage 26. Oscillation of the connecting rods 19 caused by rotation of the cam 20 mounted on the motor-driven shaft 48 governed by the motor M2 determines the frequency of to-and-fro motion of the brackets 12, supported by the crankshaft 13, between the two positions P1 and P2, whilst the movement of the connecting rods 16 and the position of the cams 17 determine the path of pitch of the brackets 12 about the point of connection 15 to the crank.

Advantageously, the motors M1, M2 may be governed to vary the relative position of the cams 17, 20 and their direction of rotation and thus adjust inclination of the brackets 12 during the cycle of to-and-fro motion, in synchronism with the vertical position determined by the motor-drive of the carriage 26.

In this way, the control of the motors M1, M2, synchronized with the speed of the rollers, enables the mobile brackets 12 to describe a given path (that may be optimized and adjusted) with the aim of then intercepting the first fold 37, i.e., of finding the start of the next pack to be formed while the folding rollers 2, 3 are carrying out a folding operation.

Illustrated in sequence in FIGS. 4*a*-4*i* and 4*l* are the successive positions assumed by the brackets 12 in a preferred embodiment of the mechanism, in particular for machines provided with two separation assemblies G set at the two sides of the stack-growth channel 33.

Figure 1:
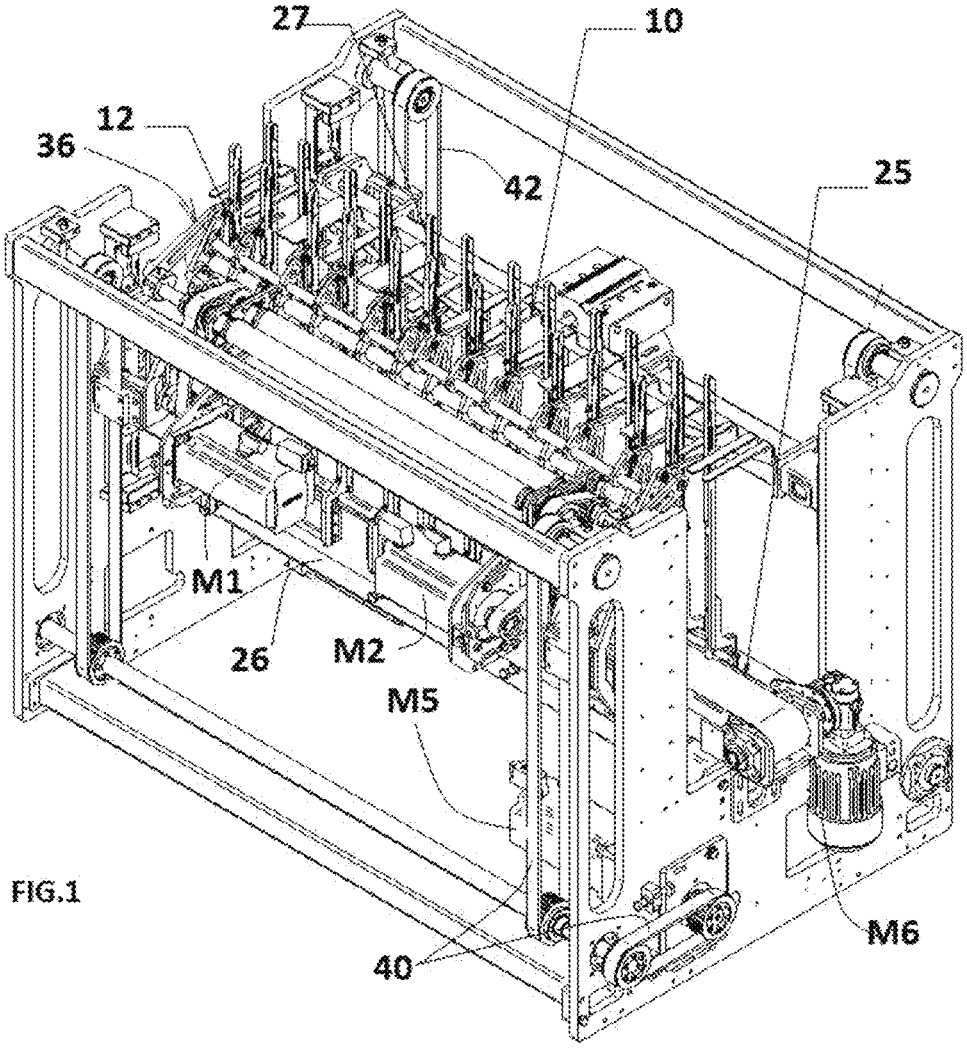
FIG. 1 is a schematic illustration of a machine according to the invention without the folding rollers in order to provide a clearer view of the mechanism for growth of the numbered packs.
Figure 2:
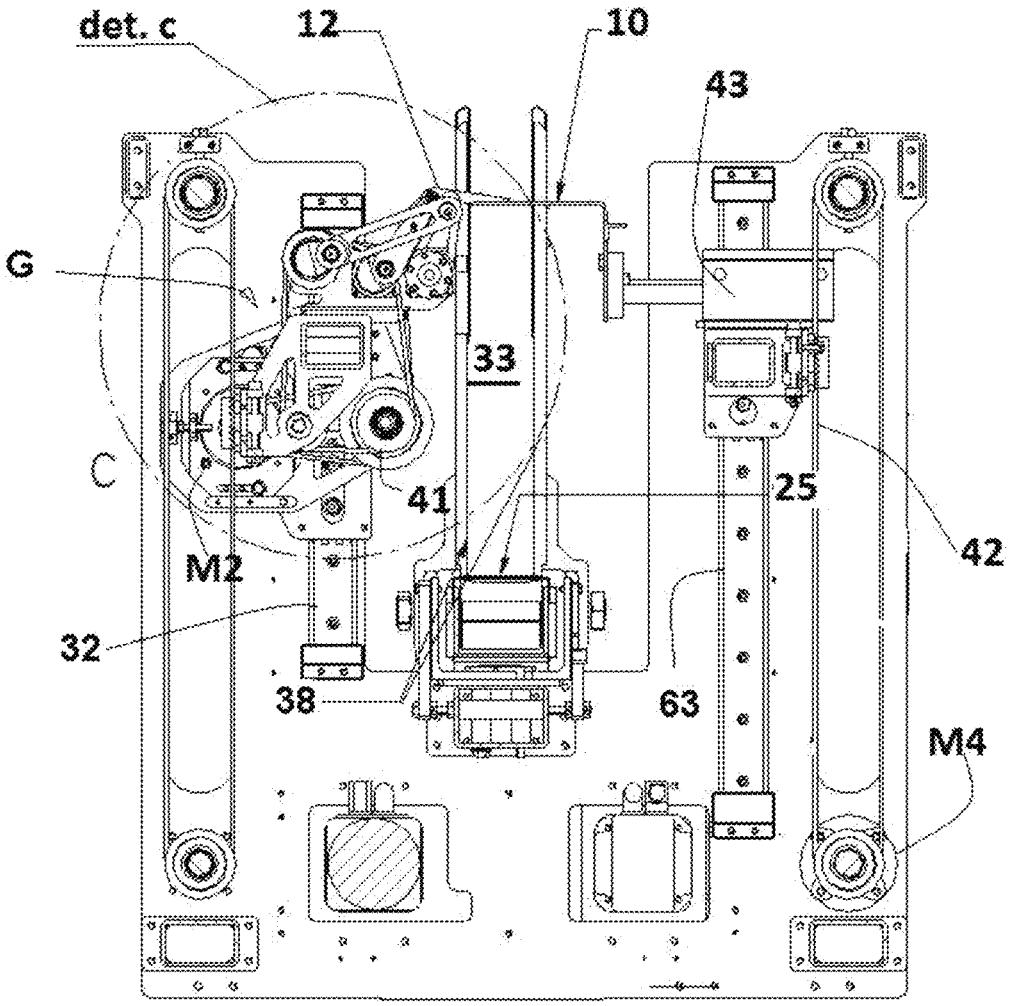
FIG. 2 shows a side view of the machine of FIG. 1.
Figure 3:
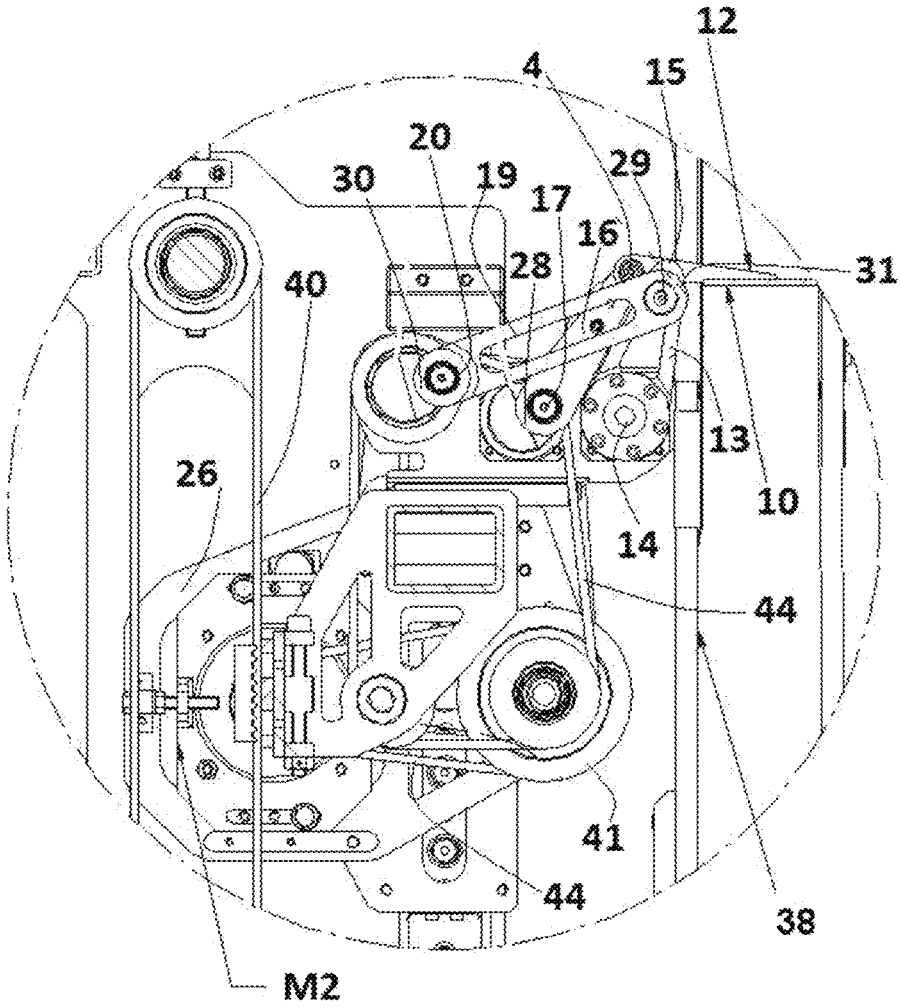
FIG. 3 shows the detail C of FIG. 2.
Figure 4A:
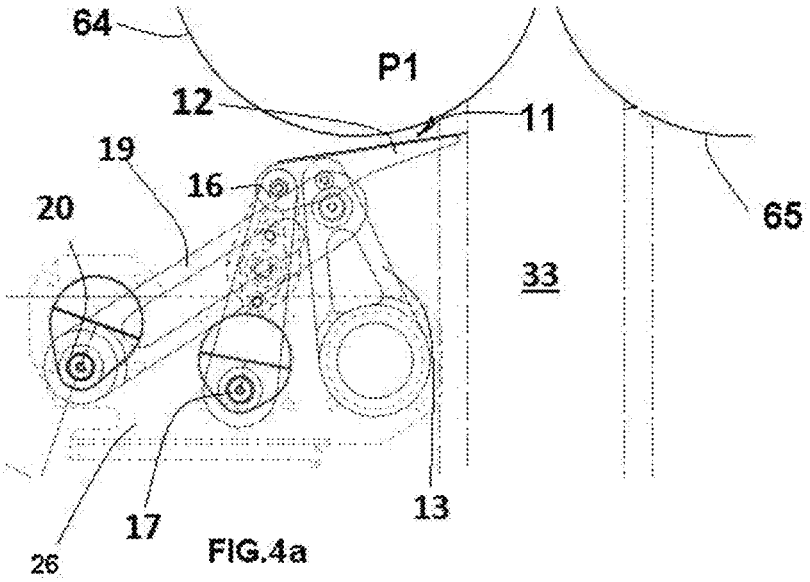

In FIG. 4*a*, the brackets 12 are in a position external to the stack-growth channel.

Figure 4B:
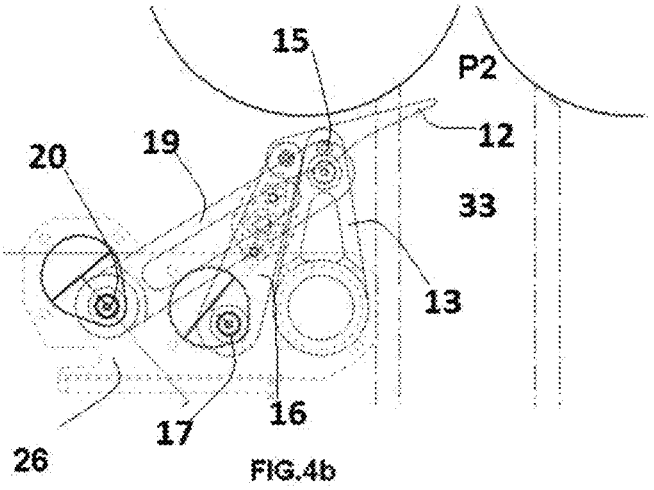

In FIG. 4*b*, the carriage 36 has remained stationary, the cams 17, 20 have both rotated in a counterclockwise direction, and the brackets 12 have come into a position of interference in the channel 33 in order to intercept the sheets of a new pack to be formed and separate the new pack from the underlying pack that has already been formed. The brackets 12 follow an inclined path due to a counterclockwise rotation about the point 15, which enables approach of the brackets 12 to the surface of the folding roller. The inclination of the brackets and hence the distance thereof from the roller may be adjusted by governing rotation of the cams 17, 20.

Figure 4C:
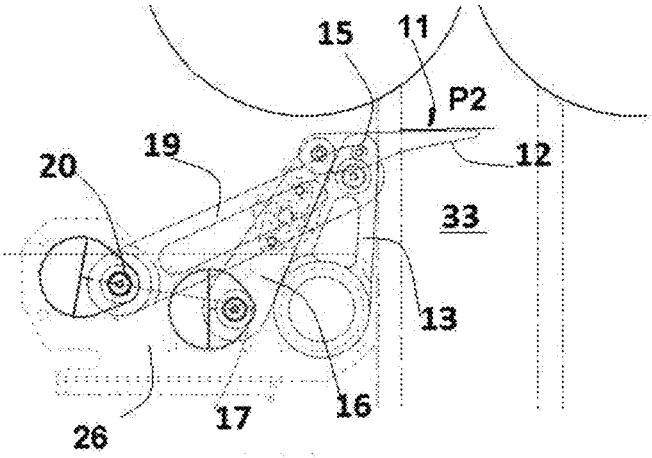

In FIG. 4*c*, the carriage 36 has still remained stationary, and the cams 17, 20 have rotated in a counterclockwise direction in such a way that the brackets 12 assume a horizontal position in the channel 33 for receiving the sheets folded by the rollers.

Figure 4D:
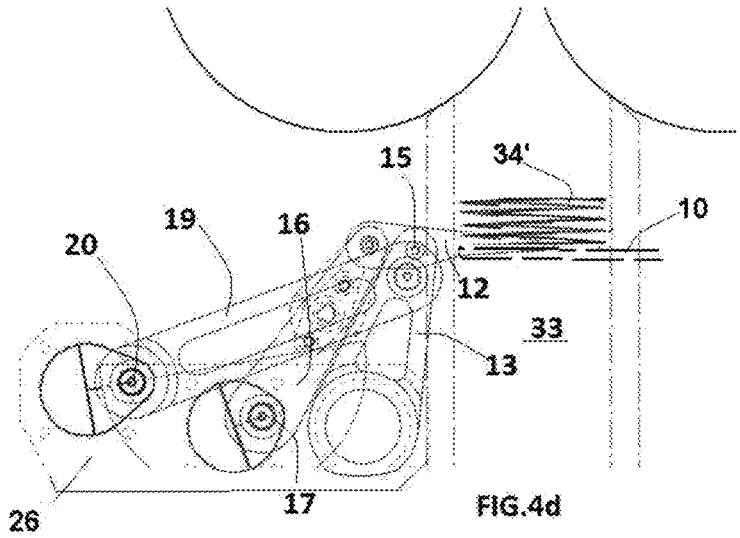
Figure 4E:
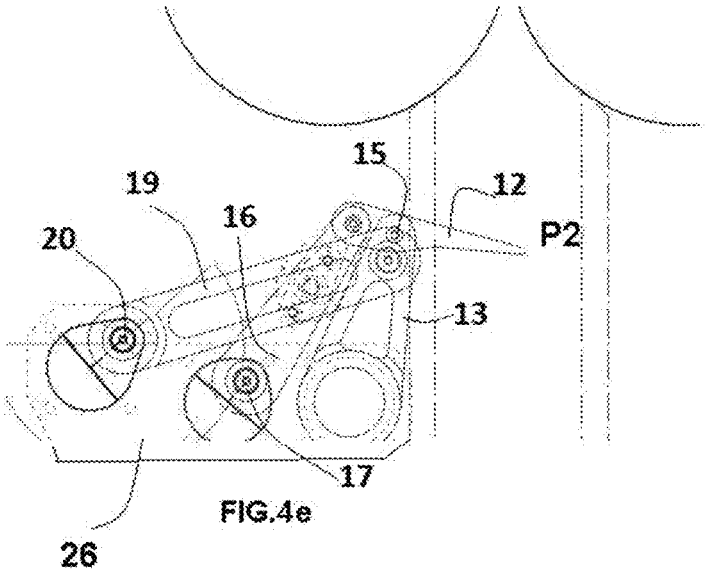
Figure 4F:
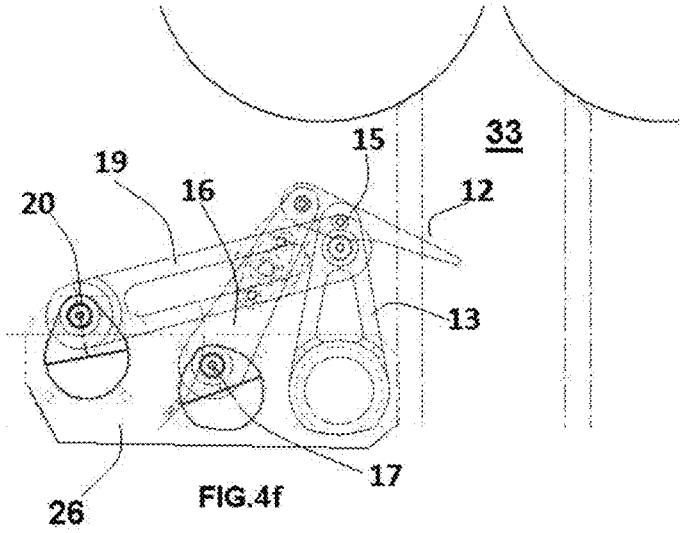
Figure 4G:
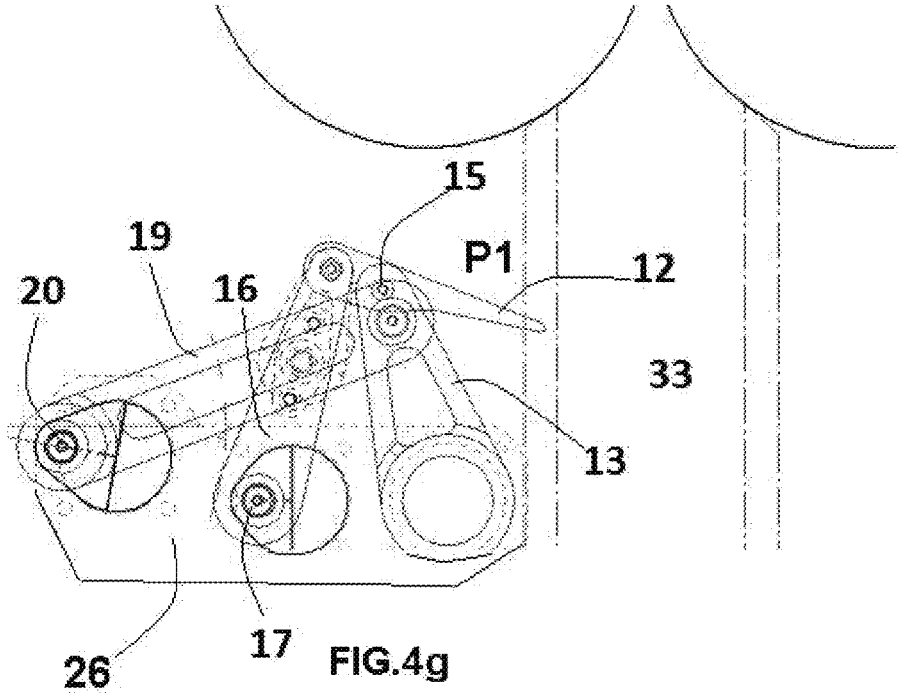
Figure 4H:
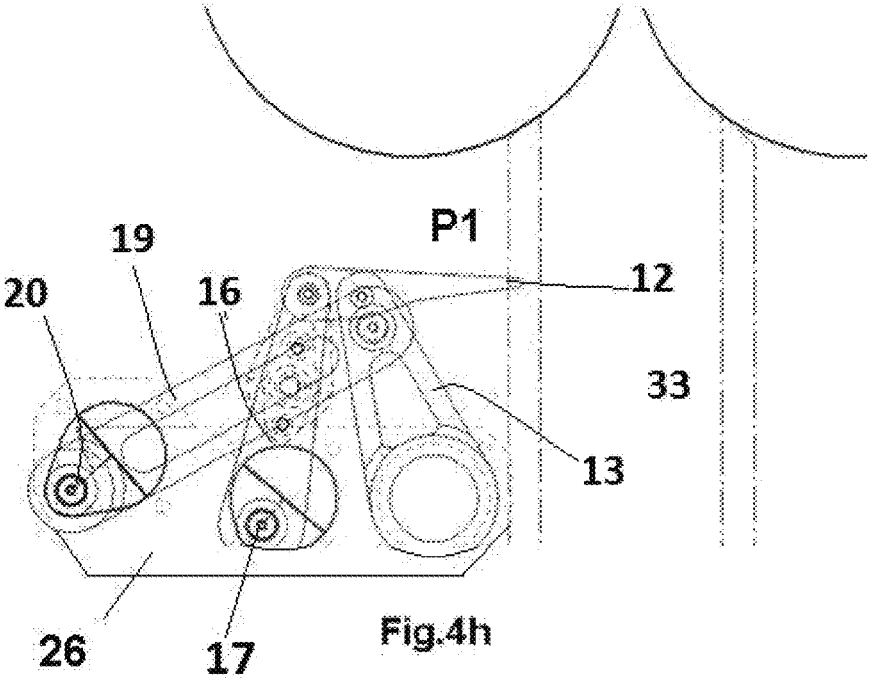

In FIG. 4*d*, the carriage 36 has dropped for gathering the sheets coming from the folding rollers, and the cams 17, 20 have both turned in a counterclockwise direction in such a way that the brackets 12 follow an inclined path due to a clockwise rotation about the point 15, which enables recession of the brackets 12 from the surface of the folding roller.

Figure 4I:
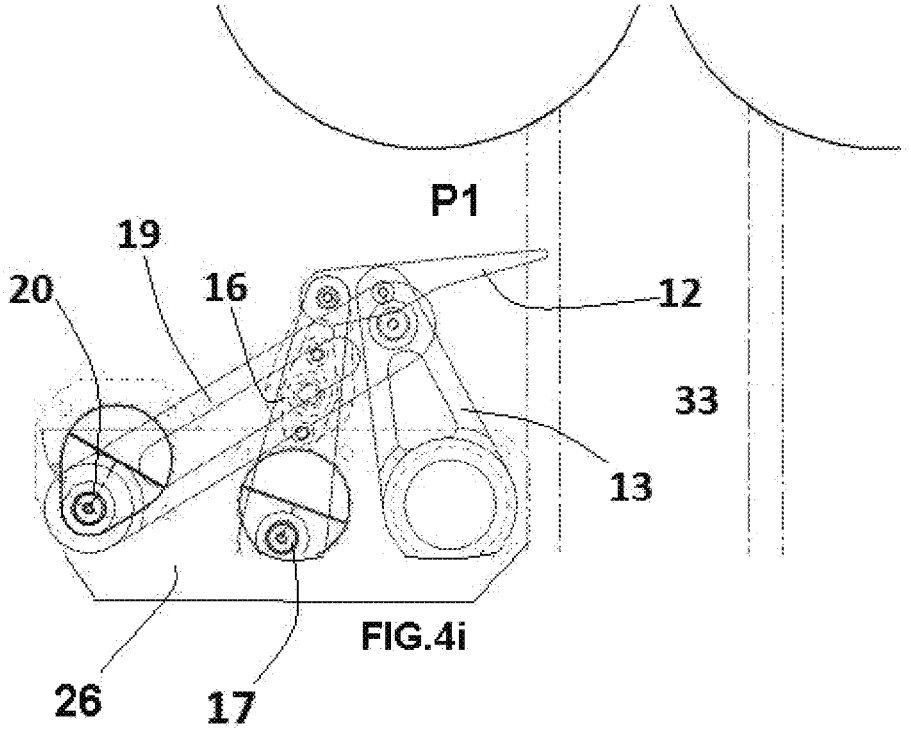

In FIGS. 4*e*-4*i*, the carriage 36 has remained stationary and the brackets 12 have proceeded in their clockwise rotation, tilting and progressively coming out of the channel 33 until they again assume a horizontal position (FIG. 4*h*) and then are again inclined upwards (FIG. 4*i*).

Figure 4L:
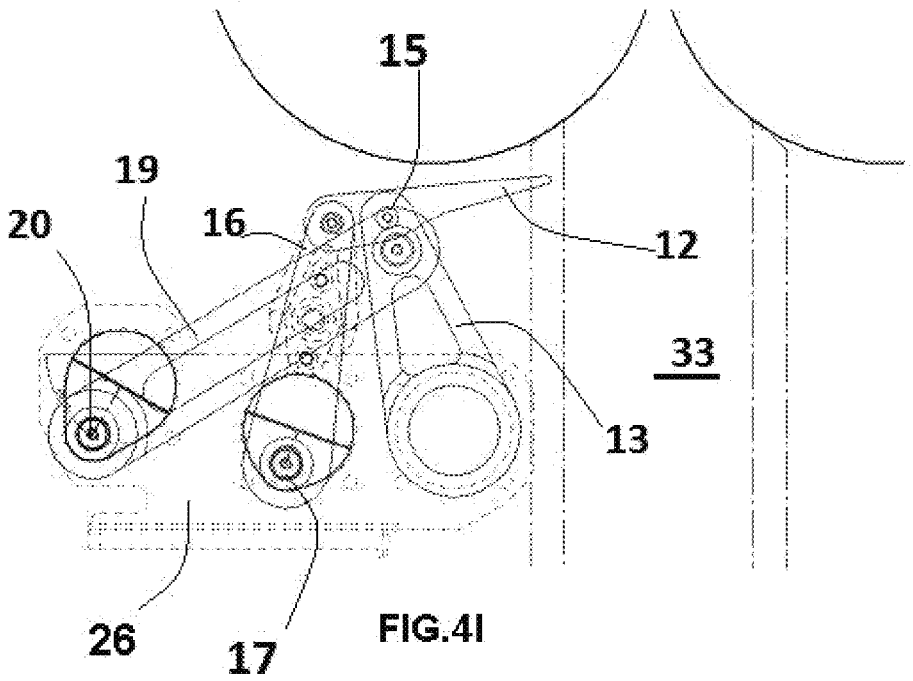

In FIG. 4*l*, the carriage 36 has gone back up and the brackets are again in the initial position external to the channel 33.

Advantageously, rotation of the brackets 12 accelerates exit of the brackets from the channel 33 and reduces the time of return to the position of non-interference, enabling the carriage 26 to go back up again so as to start a new cycle.

Described in FIGS. 8*a*-8*f* are the successive steps of the operation of a second preferred embodiment of the mechanism, which is particularly suitable when it is desired to obtain an extensive transverse range of travel of the interference brackets, i.e., that the position P2 be well below the pack being formed, for example for interleaving machines provided with just one assembly G for separating the numbered packs.

Figure 8A:
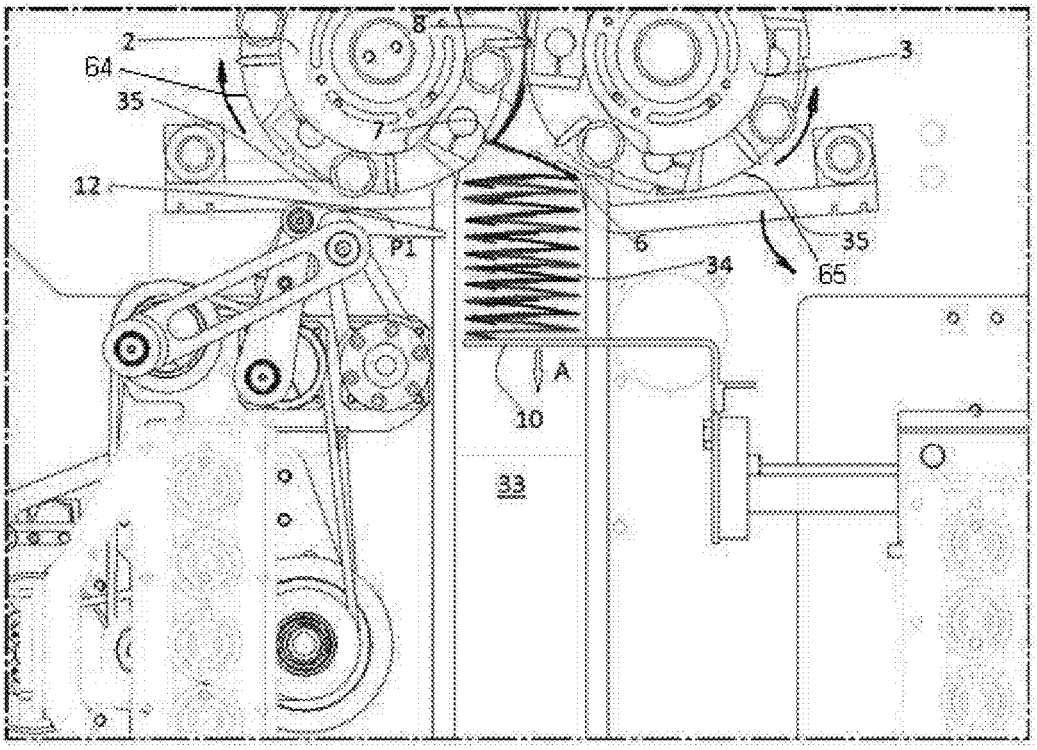

In FIG. 8*a*, the interference brackets 12 are in the position P1 moved away outside the stack-growth channel 33, the rollers 2, 3 are turning, have carried out folding in common along the line 8, and are depositing the last sheet of a numbered pack 34 gathered on the brackets 10 according to a movement of growth in the direction A.

Figure 8B:
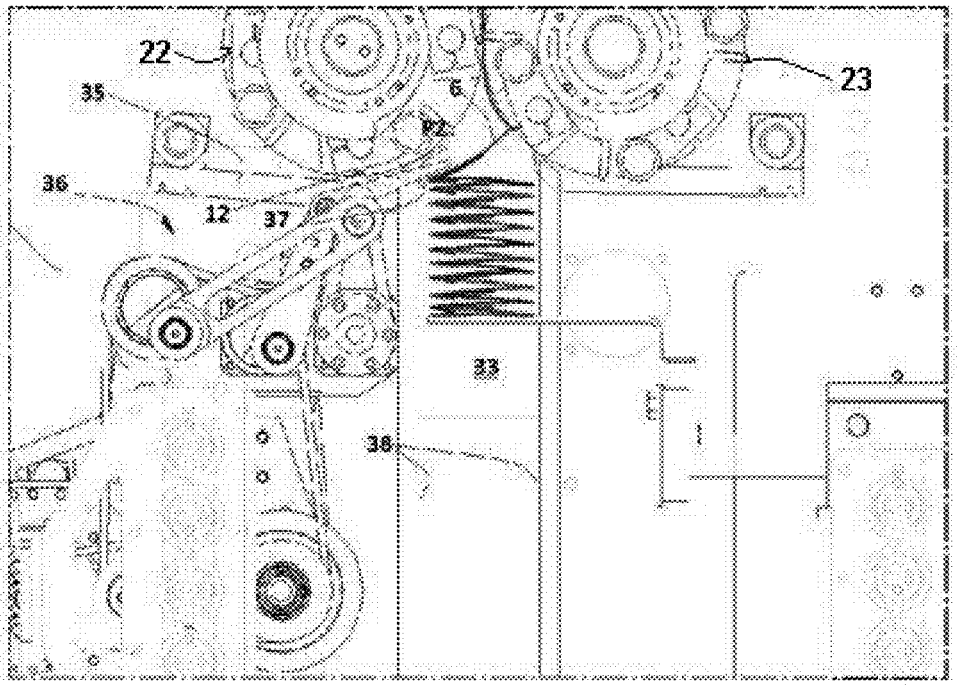

In FIG. 8*b*, the mechanism 36 has brought the interference brackets 12 underneath the rollers 2, 3 into a position P2 interfering with the stack-growth channel 33. In this step, the stack-growth brackets 10 are descending and the interference brackets 12 are following a path external and tangential to the folding roller, and intercept the sheet 6 being folded, just detached from the roller by the doctor 35, immediately downstream of the first fold 37.

Figure 8C:
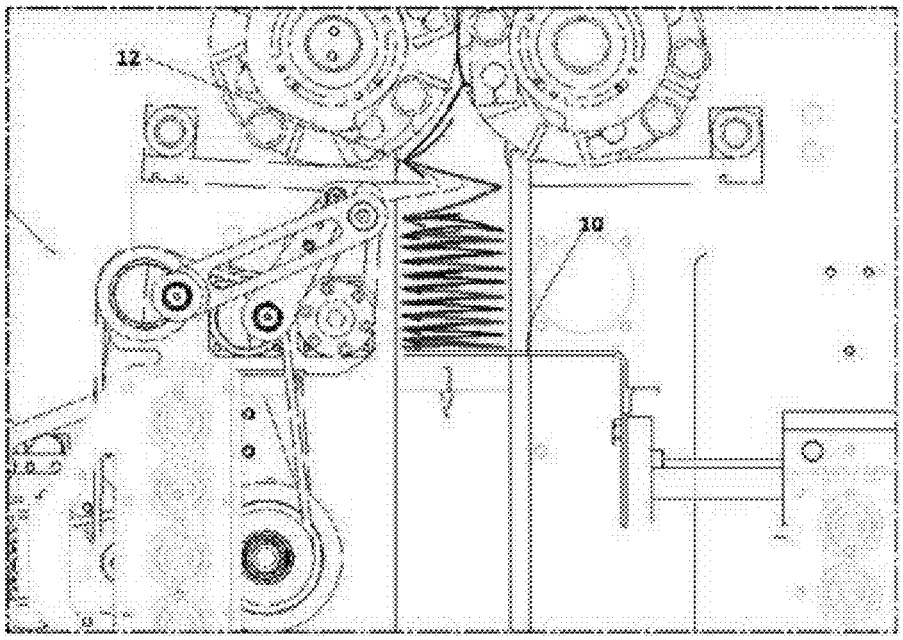

In FIG. 8*c*, the interference brackets are brought into a horizontal position to define a provisional surface of growth of the new pack, whilst the stack-growth brackets are descending with the numbered pack completed. The trailing flap of the last sheet of the completed pack is separating from the leading flap of the first sheet of the new pack.

Figure 8D:
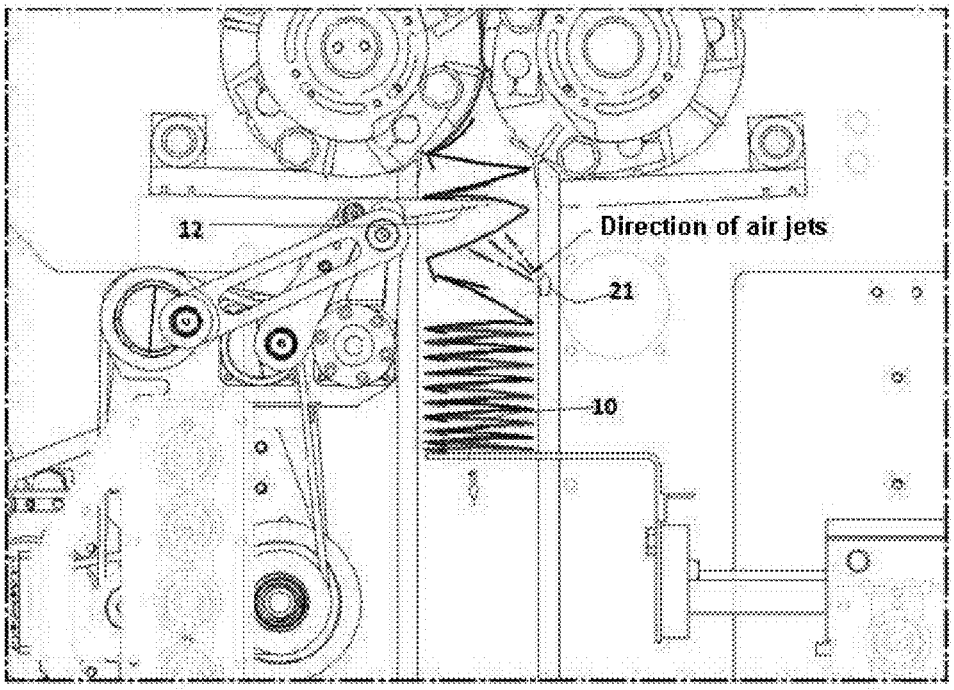

Illustrated in FIG. 8*d* is the moment when the separation between the trailing flap of the last sheet of the completed pack and the leading flap of the first sheet of the new pack is aided by means of jets of air emitted from air nozzles 21 oriented against the new pack being formed in a direction opposite to the direction of growth.

Figure 8E:
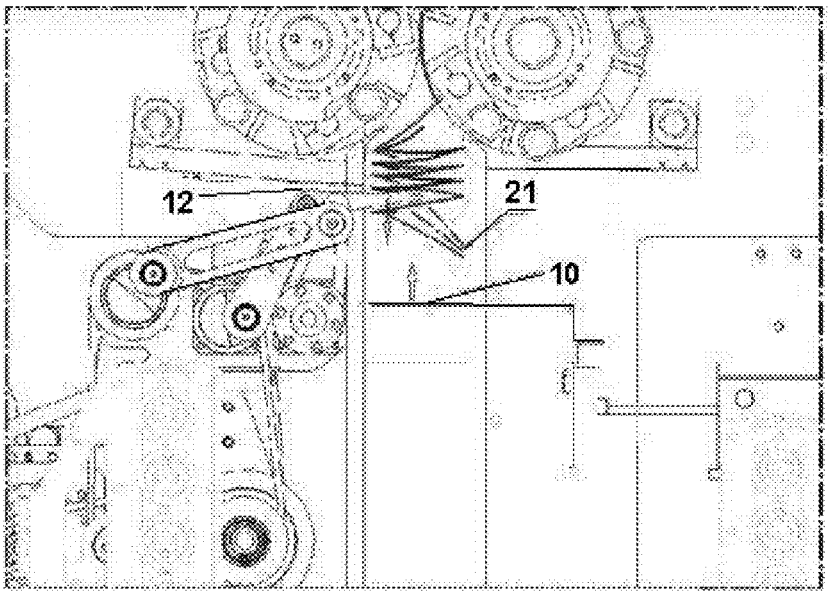

In FIG. 8*e*, the stack-growth brackets have left the numbered pack that has already been formed (detail in FIGS. 5*a*-5*e*) and are returning into a raised position underneath the interference brackets that have in the meantime gathered a partial number of sheets 6 that are to form the new pack. In this step, the nozzles 21 blow air in the direction of the leading flap of the first sheet of the pack being formed to guarantee correct positioning thereof at the moment when it is then laid on top of the stack-growth brackets.

Figure 8F:
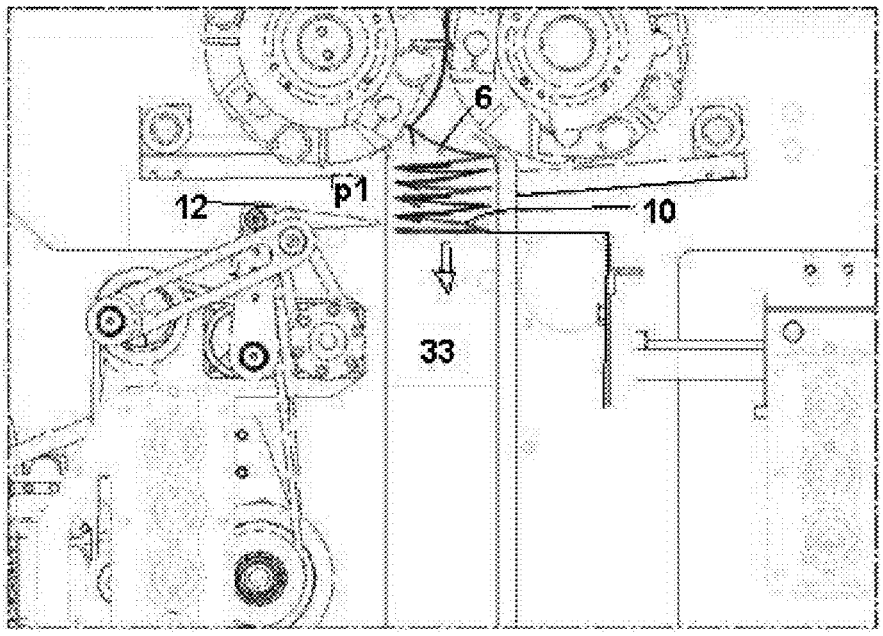

In FIG. 8*f*, the new pack is being formed on the stack-growth brackets 12, which are dropping, whilst the interference brackets have slid out in a direction transverse to the channel 33, leaving the sheets 6 on the stack-growth brackets, to return then into the position P1 of non-interference.

Illustrated in FIGS. 5*a*-5*e* is the movement of the numbered packs along the stack-growth channel 33 and on the conveyor belt 25.

Figure 5A:
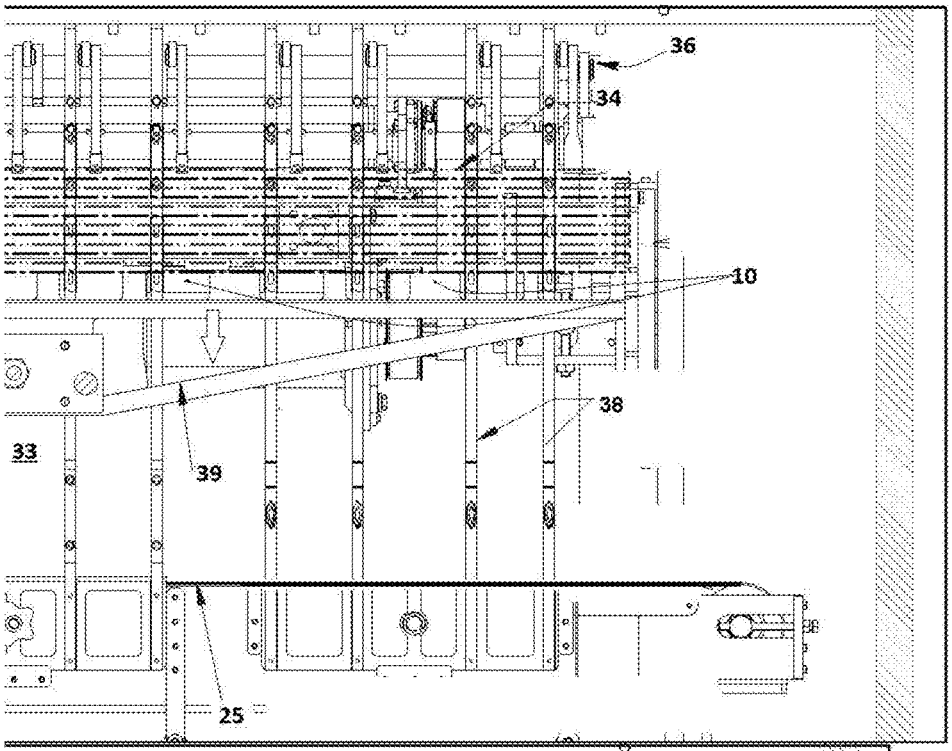

In FIG. 5*a*, the pack being formed 34 is descending along the stack-growth channel 33 being gathered on the brackets 10, carried by a common structure 39, which extends throughout the width of the sheets. The conveyor belt is stationary, waiting to receive the pack 34.

Figure 5B:
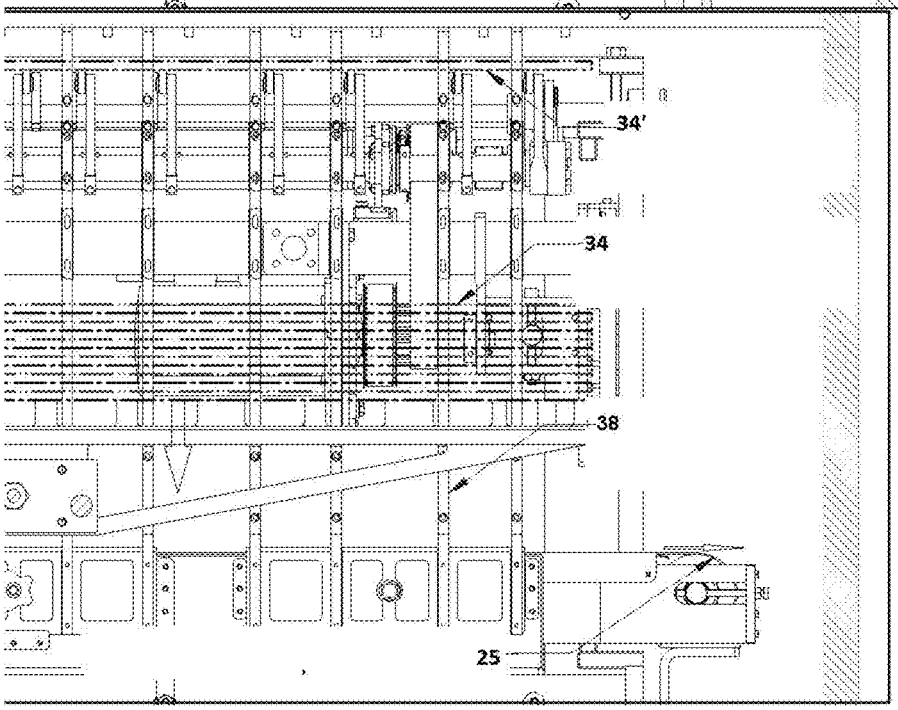

In FIG. 5*b*, a pack that has been formed 34 is descending along the stack-growth channel 33 being gathered on the brackets 10, whilst a new pack 34' is starting to gather on the interference brackets 12. The belt 25 is still stationary underneath the incoming pack 34.

Figure 5C:
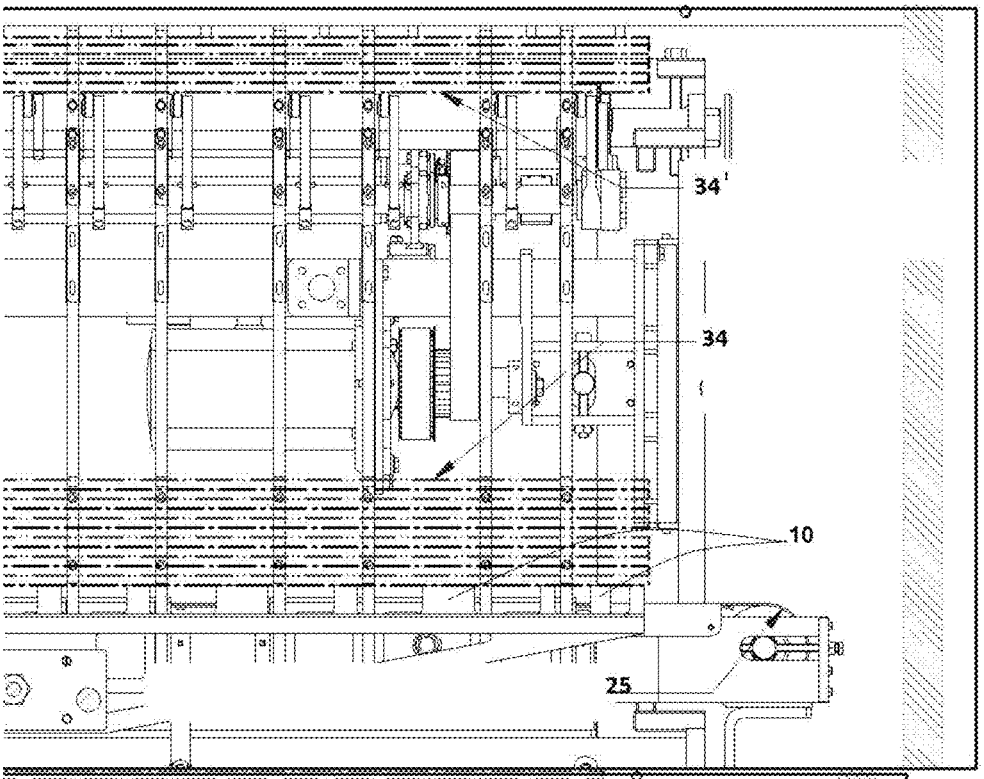

In FIG. 5*c*, the pack that has been formed 34 is laid by the posts 10 on the belt 25, while a new pack 34' is continuing to form on the interference brackets 12. The belt 25 is still stationary.

Figure 5D:
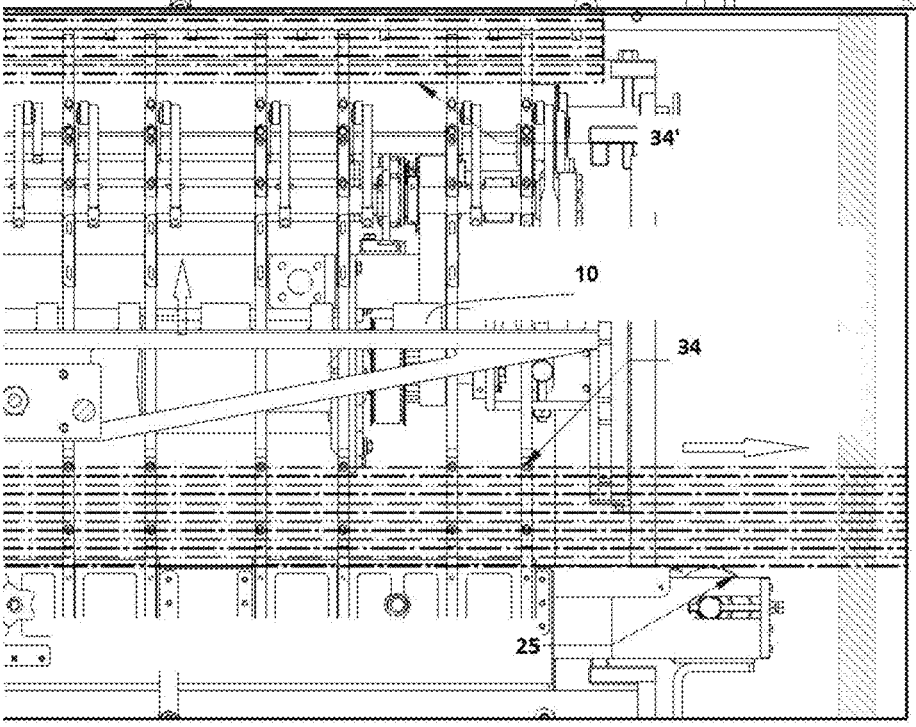

In FIG. 5*d*, the pack that has been formed 34 is translated laterally by the belt 25 out of the channel 33, while the new pack 34 is being formed on the interference brackets. The stack-growth brackets are moving upwards.

Figure 5E:
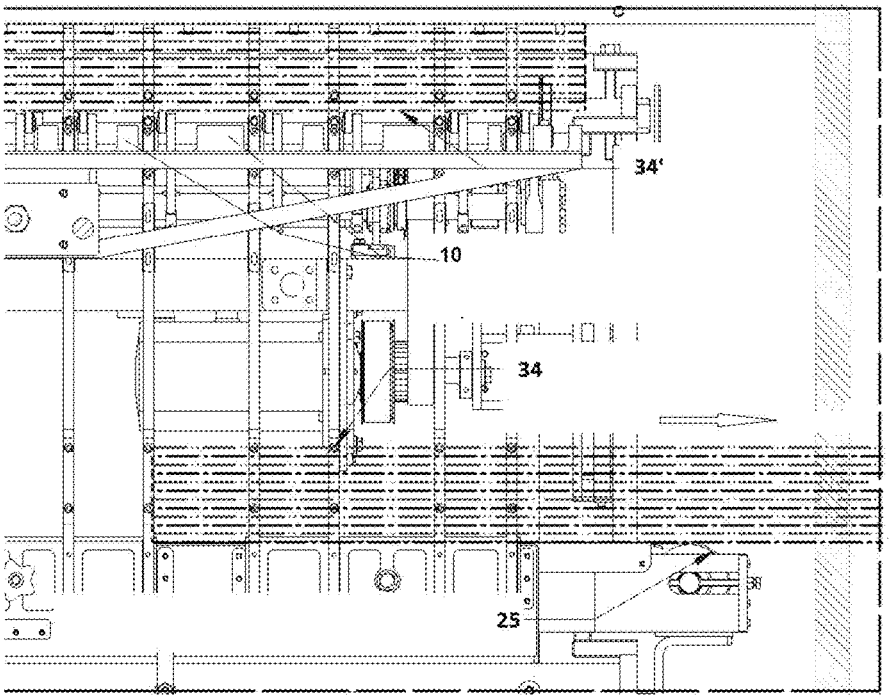

In FIG. 5*e*, the pack that has been formed 34 is again translated laterally by the belt 25, and the new pack 34 is being formed on the interference brackets, with the stack-growth brackets in a position of exchange, ready to receive the pack 34' from the interference brackets and start a new cycle.

The invention achieves important advantages because it enables use of the same equipment for formation of numbered packs of interleaved sheets of different format by merely regulating the geometry of the mechanism for governing the interference brackets.

Furthermore, the invention reduces the need to make toroidal slots in the folding rollers and thus improves the quality of the sheets throughout the width of the format. The present invention has been described according to preferred embodiments, but equivalent variants may be devised, without thereby departing from the sphere of protection granted.

The invention claimed is:

1. A machine for the formation of numbered packs of interleaved sheets of paper (6), comprising:

a pair of counter-rotating motor-driven folding rollers (2, 3) shaped on the surface so as to interfere along a plurality of folding lines (7, 8), each roller being fed by a respective supply of sheets (6), which are drawn, in a reciprocating way, by the surfaces (64, 65) of the rollers (2, 3), into a position staggered one with respect to the next so as to be set overlapping along at least one common folding line (7) of interleaving;

an interference surface (11) defined by a plurality of parallel interference brackets (12), the interference surface (11) being mobile with a to-and-fro motion between a position (P1) of non-interference and a position (P2) of interference, synchronized with the speed of rotation of the rollers (2, 3) for interrupting cyclically the succession of folded sheets that are released by the rollers and are to form numbered packs of interleaved sheets of paper; and a mechanism (36) having two degrees of freedom for cyclic movement of the surface (11) supported by a motor-driven carriage (26) mobile in a direction of recession from the rollers (2, 3), said mechanism (36) comprising at least one supporting crank (13) oscillating with respect to the carriage (26) and articulated to the surface (11) about a first axis (15) of rotation, a first motor-driven connecting rod (19) driven by a first motor, mounted on a first cam (20) and kinematically connected to the surface (11) to bestow said to-and-fro motion thereon, and a second motor-driven connecting rod (16) driven by a second motor and mounted on a second cam (17) supported by the carriage (26) and connected the surface (11) about a second axis (4) of rotation.

2. The machine according to claim 1, wherein said plurality of interference brackets (12) are distributed throughout the length of the rollers (2, 3) and extending in a direction transverse to the line of growth, and wherein said mechanism comprises:

at least one oscillating crank (13) articulated to a fixed point (14) of said carriage and to an intermediate point (15) of a corresponding one of said interference brackets (12);

the first motor-driven connecting rod (19) moved by the first motor and articulated to the first cam (20) mounted on said carriage and to a crank (13);

the second motor-driven connecting rod (16) moved by the second motor, and articulated to the second cam (17) mounted on said carriage and to one end (4) of at least one of said interference brackets (12), wherein the relative position at start of cycle of said cams (17, 20) is adjustable, and said first and second motors are synchronized with one another and with the speed of rotation of the folding rollers (2, 3).

3. The machine according to claim 1, wherein said surface (11) presents a rotary movement of return from the position of interference (P2) to the position of non-interference (P1), in said return movement the surface (11) assuming an orientation inclined with respect to the common tangent of said rollers (2, 3).

4. The machine according to claim 1, further comprising a distribution of stack-growth brackets (10) set downstream of the folding rollers with respect to a line of growth (A) for gathering a succession of interleaved sheets of paper set on top of one another, the stack-growth brackets being motor-driven so as to move along the line of growth (A) at a rate associated to the speed of rotation of the rollers, and wherein said surface (11) presents a movement parallel to the line of growth (A).

5. The machine according to claim 1, further comprising a distribution of stack-growth brackets (10) set downstream of the folding rollers with respect to a line of growth (A) for gathering a succession of interleaved sheets of paper set on top of one another, the stack-growth brackets being motor-driven so as to move along the line of growth (A) at a rate associated to the speed of rotation of the rollers, and wherein said surface (11) presents a movement parallel to the line of growth (A), wherein the movement of said mechanism (36) is synchronized with the movement of said carriage and of said stack-growth brackets.

6. The machine according to claim 1, wherein said mechanism is adjustable to enable the interference brackets to describe a predetermined path of interception of a common folding line of said interleaved sheets of paper.

7. The machine according to claim 1, wherein the interference brackets describe said path of interception while the folding rollers are making a new fold on the sheets (6).

8. The machine according to claim 1, further comprising air nozzles (21) for directing jets of air towards said interleaved sheets of paper in a direction opposite to the direction of growth.

9. The machine according to claim 4, further comprising removal means (25) for removal of said numbered packs of interleaved sheets of paper from said stack-growth brackets, said removal means (25) provided with a motor-drive synchronized with the stack-growth brackets being motor driven.

10. The machine according to claim 9, wherein said removal means comprise a horizontal conveyor belt (25).

11. The machine according to claim 2, wherein said surface (11) presents a rotary movement of return from the position of interference (P2) to the position of non-interference (P1), in said return movement the surface (11) assuming an orientation inclined with respect to the common tangent of said rollers (2, 3).

12. The machine according to claim 2, further comprising a distribution of stack-growth brackets (10) set downstream of the folding rollers with respect to a line of growth (A) for gathering a succession of interleaved sheets of paper set on top of one another, the stack-growth brackets being motor-driven so as to move along the line of growth (A) at a rate associated to the speed of rotation of the rollers, and wherein said surface (11) presents a movement parallel to the line of growth (A).

13. The machine according to claim 2, wherein the movement of said mechanism (36) is synchronized with the movement of said carriage and of said stack-growth brackets.

14. The machine according to claim 2, wherein said mechanism is adjustable to enable the interference brackets to describe a predetermined path of interception of a common folding line of said interleaved sheets of paper.

15. The machine according to claim 2, wherein the interference brackets describe said path of interception while the folding rollers are making a new fold on the sheets (6).

16. The machine according to claim 2, further comprising air nozzles (21) for directing jets of air towards said interleaved sheets of paper in a direction opposite to the direction of growth.

17. The machine according to claim 2, further comprising:

a distribution of stack-growth brackets (10) set downstream of the folding rollers with respect to a line of growth (A) for gathering a succession of interleaved sheets of paper set on top of one another, the stack-growth brackets being motor-driven so as to move along the line of growth (A) at a rate associated to the speed of rotation of the rollers, and wherein said surface (11) presents a movement parallel to the line of growth (A), and removal means (25) for removal of said numbered packs of interleaved sheets of paper from said stack-growth brackets, said removal means (25) provided with a motor-drive synchronized with the stack-growth brackets being motor driven.

18. The machine according to claim 17, wherein said removal means comprise a horizontal conveyor belt (25).

19. A machine for the formation of numbered packs of interleaved sheets of paper (6), comprising:

a pair of counter-rotating motor-driven folding rollers (2, 3) shaped on the surface so as to interfere along a plurality of folding lines (7, 8), each roller being fed by a respective supply of sheets (6), which are drawn, in a reciprocating way, by the surfaces (64, 65) of the rollers (2, 3), into a position staggered one with respect to the next so as to be set overlapping along at least one common folding line (7) of interleaving;

an interference surface (11), which is mobile with a to-and-fro motion between a position (P1) of non-interference and a position (P2) of interference, synchronized with the speed of rotation of the rollers (2, 3) for interrupting cyclically the succession of folded sheets that are released by the rollers and are to form numbered packs of interleaved sheets of paper, a mechanism (36) for cyclic movement of the surface (11) supported by a motor-driven carriage (26) mobile in a direction of recession from the rollers (2, 3), said mechanism (36) comprising i) at least one supporting crank (13) oscillating with respect to the carriage (26) and articulated to the surface (11) about a first axis (15) of rotation, ii) a first motor-driven oscillating connecting rod (19) kinematically connected to the surface (11) to bestow said to-and-fro motion thereon, and iii) a second motor-driven oscillating connecting rod (16) mounted on a first cam (17) supported by the carriage (26) and connected the surface (11) about a second axis (4) of rotation, wherein said surface (11) is defined by a plurality of interference brackets (12) distributed throughout the length of the rollers (2, 3) and extending in a direction transverse to the line of growth, and wherein said mechanism comprises:

at least one oscillating crank (13) articulated to a fixed point (14) of said carriage and to an intermediate point (15) of a corresponding one of said interference brackets (12);

the first motor-driven oscillating connecting rod (19) moved by a first motor (M1, M2) and articulated to a second cam (20) mounted on said carriage and to a crank (13);

the second motor-driven oscillating connecting rod (16) moved by a second motor (M2, M1), and articulated to the first cam (17) mounted on said carriage and to one end (4) of at least one of said interference brackets (12), wherein the relative position at start of cycle of said first and second cams (17, 20) is adjustable, and said first and second motors are synchronized with one another and with the speed of rotation of the folding rollers (2, 3).

20. The machine according to claim 19, further comprising:

a distribution of stack-growth brackets (10) set downstream of the folding rollers with respect to a line of growth (A) for gathering a succession of interleaved sheets of paper set on top of one another, the stack-growth brackets being motor-driven so as to move along the line of growth (A) at a rate associated to the speed of rotation of the rollers, and wherein said surface (11) presents a movement parallel to the line of growth (A), and removal means (25) for removal of said numbered packs of interleaved sheets of paper from said stack-growth brackets, said removal means (25) provided with a motor-drive synchronized with the stack-growth brackets being motor driven.

* * * * *